US011125074B2

(12) United States Patent
Harvey et al.

(10) Patent No.: US 11,125,074 B2
(45) Date of Patent: Sep. 21, 2021

(54) MARKER SIGNAL FOR SUBTERRANEAN DRILLING

(71) Applicant: Nabors Drilling Technologies USA, Inc., Houston, TX (US)

(72) Inventors: Peter Harvey, Tampa, FL (US); Pradeep Annaiyappa, Houston, TX (US); Tyler Clark, Montgomery, TX (US); Kirk Towns, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 224 days.

(21) Appl. No.: 16/393,528

(22) Filed: Apr. 24, 2019

(65) Prior Publication Data

US 2019/0330973 A1 Oct. 31, 2019

Related U.S. Application Data

(60) Provisional application No. 62/663,046, filed on Apr. 26, 2018.

(51) Int. Cl.

| | |
|---|---|
| ***E21B 47/04*** | (2012.01) |
| ***E21B 45/00*** | (2006.01) |
| ***E21B 47/0228*** | (2012.01) |
| ***E21B 47/01*** | (2012.01) |
| ***E21B 44/08*** | (2006.01) |

(Continued)

(52) U.S. Cl.

CPC ..... *E21B 47/0228* (2020.05); *E21B 44/08* (2013.01); *E21B 45/00* (2013.01); *E21B 47/01* (2013.01); *E21B 47/024* (2013.01); *E21B 47/04* (2013.01); *E21B 47/13* (2020.05); *E21B 2200/22* (2020.05)

(58) Field of Classification Search

CPC ..... E21B 47/04; E21B 47/095; E21B 47/18; E21B 45/00

See application file for complete search history.

(56) References Cited

U.S. PATENT DOCUMENTS 5,200,705 A * 4/1993 Clark ..... G01V 3/20 324/338
5,678,643 A * 10/1997 Robbins ..... G01V 1/46 175/45

(Continued)

FOREIGN PATENT DOCUMENTS

WO 2016182799 A1 11/2016

*Primary Examiner* — Shane Bomar
(74) *Attorney, Agent, or Firm* — Abel Schillinger, LLP; Enrique Abarca

(57) ABSTRACT

A method of subterranean drilling comprising monitoring at least one drilling criteria at the surface; communicating a marker signal to a bottom hole assembly of a drill string upon meeting a condition of the at least one drilling criteria; and repeating the marker signal at least two consecutive times the condition is met. In an embodiment, the marker signal can be repeated every time the condition is met. A system for subterranean drilling comprising a drill rig adapted to monitor at least one drilling criteria at the surface; a communication element adapted to communicate a marker signal to a bottom hole assembly of a drill string upon meeting a condition of the at least one drilling criteria, wherein the communication element is adapted to communicate the marker signal to the bottom hole assembly at least two consecutive times the condition is met.

18 Claims, 2 Drawing Sheets

(51) Int. Cl.
*E21B 47/024* (2006.01)
*E21B 47/13* (2012.01)

(56) References Cited

U.S. PATENT DOCUMENTS

| | | | | |
|---|---|---|---|---|
| 6,708,783 | B2 | 3/2004 | Moore et al. | |
| 2004/0206170 | A1* | 10/2004 | Chen | E21B 44/00 73/152.49 |
| 2004/0217880 | A1* | 11/2004 | Clark | E21B 17/028 340/854.9 |
| 2006/0180349 | A1 | 8/2006 | Dashevskiy | |
| 2008/0137474 | A1 | 6/2008 | Dashevskiy et al. | |
| 2010/0305864 | A1* | 12/2010 | Gies | E21B 47/095 702/9 |
| 2013/0106615 | A1* | 5/2013 | Prammer | H04L 25/24 340/854.6 |
| 2013/0319767 | A1* | 12/2013 | Wilson | E21B 47/26 175/24 |
| 2015/0218929 | A1 | 8/2015 | Narasimhan et al. | |
| 2015/0226050 | A1 | 8/2015 | Bartel et al. | |
| 2016/0084077 | A1* | 3/2016 | Lehr | E21B 21/103 367/83 |
| 2016/0123134 | A1 | 5/2016 | Viens | |
| 2016/0187527 | A1* | 6/2016 | Berheide | G01V 5/14 250/267 |
| 2017/0254189 | A1 | 9/2017 | Tamboise | |
| 2021/0071521 | A1* | 3/2021 | Li | E21B 49/08 |

* cited by examiner

MARKER SIGNAL FOR SUBTERRANEAN DRILLING

CROSS REFERENCE TO RELATED APPLICATION

The present application claims priority under 35 U.S.C. § 119(e) to U.S. Provisional Patent Application No. 62/663,046 filed Apr. 26, 2018, entitled "Marker Signal for Subterranean Drilling," naming inventors Peter Harvey et al., which is assigned to the current assignee hereof and is incorporated by reference herein in its entirety.

FIELD OF THE DISCLOSURE

The present disclosure relates to subterranean drilling systems and methods, and more particular to marker signals for use in subterranean drilling operations.

RELATED ART

Drilling subterranean wells for oil and gas is complex and requires advanced systems and operations for successful oil and gas extraction. Drill rigs positioned on the surface bore into subterranean formations using drill strings comprised of discrete pipe segments including thin-walled tubulars terminating at a bottom hole assembly. The bottom hole assembly typically includes a drill bit to optimize the rate of penetration into the formation.

As drilling commences, the bottom hole assembly advances hundreds or thousands of feet below the surface. The bottom hole assembly can be advanced horizontally in certain directional drilling applications. The result of such long, non-linear wellbores can create inconsistencies in bottom hole assembly coordinate positioning—both in a three dimensional X-, Y-, Z-coordinate space and in time. That is, logic elements and/or sensors relating to the bottom hole assembly can drift from absolute coordinate positioning. Given the expensive and complex nature of drilling operations and the ever increasing need for improved efficiency, such drift can not be tolerated in the drilling industry. Continued improvements are thus demanded by the drilling industry.

BRIEF DESCRIPTION OF THE DRAWINGS

Embodiments are illustrated by way of example and are not limited in the accompanying figures.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the drilling arts.

Figure 2:
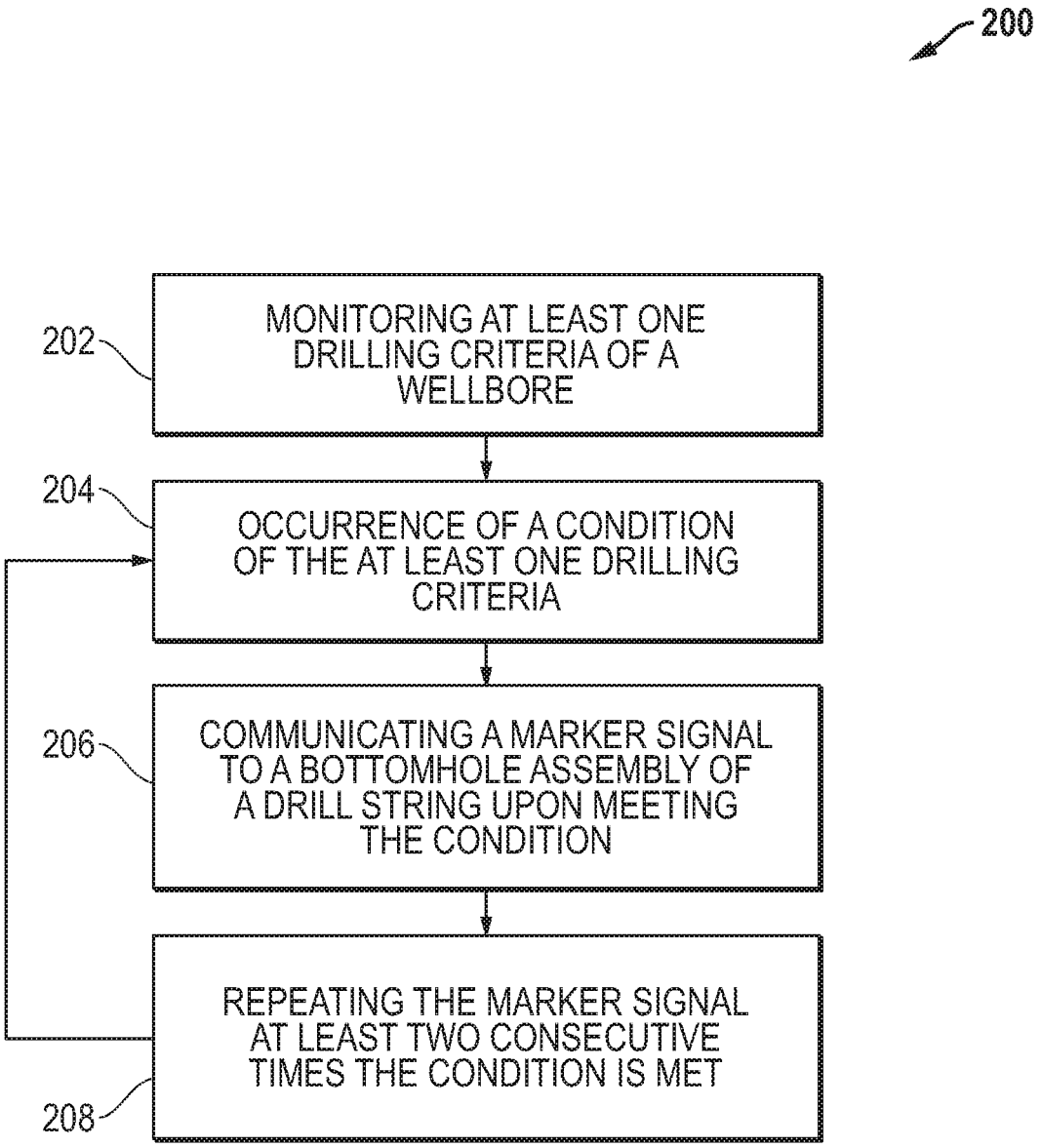
FIG. 2 includes a flowchart of a method of subterranean drilling in accordance with an embodiment.

In an embodiment, a method 200 (FIG. 2) of subterranean drilling can include monitoring 202 at least one drilling criteria at a surface of a wellbore, communicating 206 a marker signal to a bottom hole assembly of a drill string upon meeting 204 a condition of the at least one drilling criteria, and repeating 208 the marker signal at least two consecutive times the condition is met. In a particular embodiment the communication of the marker signal to the bottom hole assembly is performed every time the condition is met. In a further embodiment, the marker signal is received at the bottom hole assembly. The bottom hole assembly can determine a coordinate of the bottom hole assembly in response to receiving the marker signal.

In another embodiment, a system for subterranean drilling can include a drill rig adapted to monitor at least one drilling criteria at the surface of the wellbore. The system can further include a communication element adapted to communicate a marker signal to the bottom hole assembly of the drill string upon meeting the condition of the at least one drilling criteria. The communication assembly can be adapted to communicate the marker signal to the bottom hole assembly at least two consecutive times the condition is met.

Figure 1:
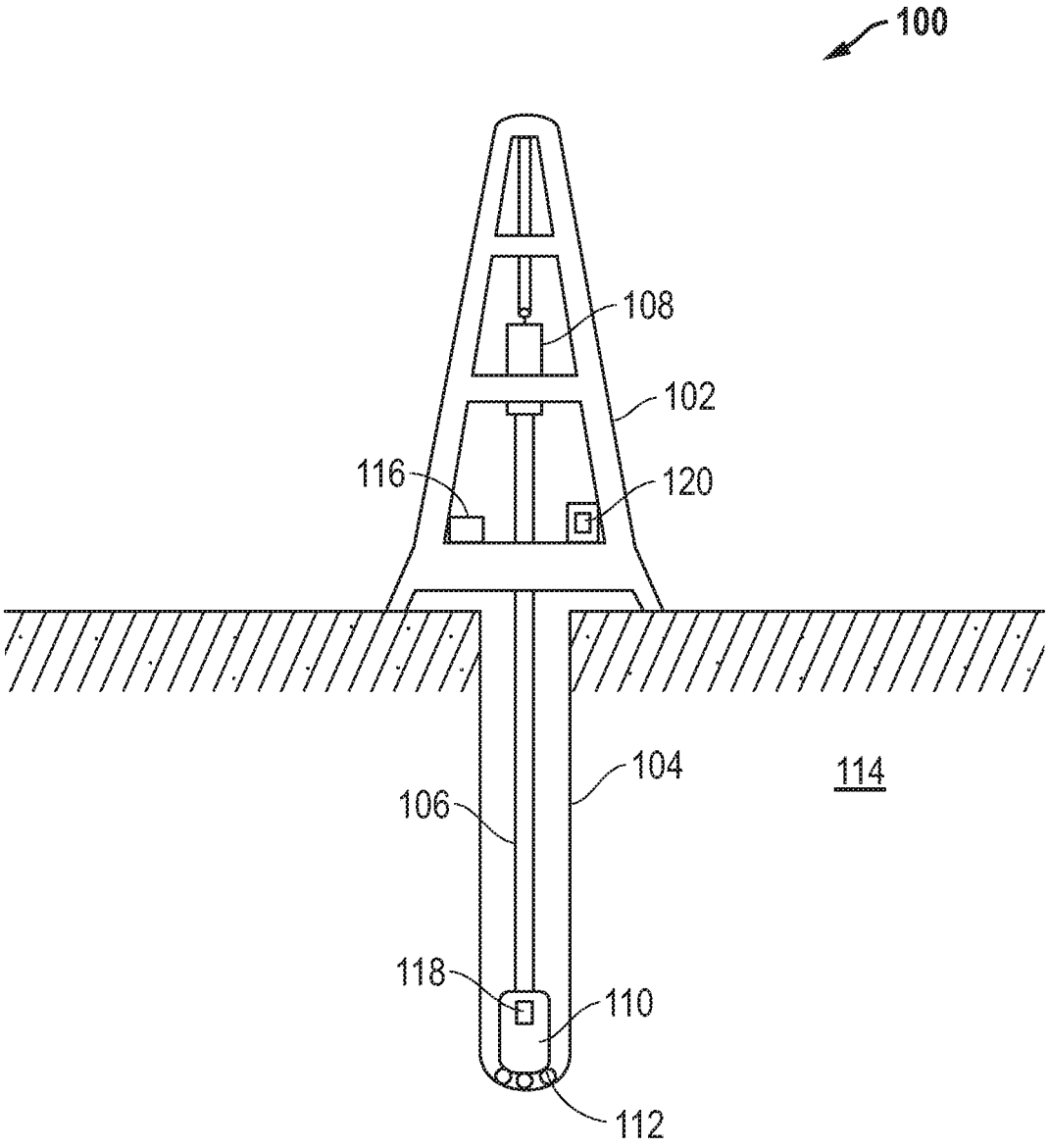
FIG. 1 includes a schematic of a system for subterranean drilling in accordance with an embodiment.

Referring to FIG. 1, a drill rig 100 can generally include a derrick 102 disposed over a wellbore 104. In an embodiment, the drill rig 100 can include a land-based drill rig. In another embodiment, the drill rig 100 can include a water-based drill rig spaced apart from the wellbore 104 by a body of water.

In an embodiment, a drill string 106 can be advanced into the wellbore 104 using a top drive 108 suspended from the derrick 102. In another embodiment, the drill string 106 can be advanced using a rotary table and kelly (not illustrated) or any other readily known drill string driving system. In an embodiment, the driving system can be operated from a control console on the drill rig 100. In another embodiment, the driving system can be operated remotely from a location spaced apart from the drill rig 100. In yet a further embodiment, the driving system can be autonomously or semi-autonomously operated.

A bottom hole assembly (BHA) 110 disposed at a lower terminal end of the drill string 106 can include a drill bit 112 including a cutting element adapted to penetrate into a subterranean formation 114. In a particular embodiment, the drill bit 112 can include a roller-cone bit. The drill bit 112 can further include a circulating element such as a mud motor (not illustrated) adapted to permit circulation of drilling fluid from a mud pit through the wellbore to improve the rate of penetration (ROP) of the BHA 110 into the subterranean formation 114. Additionally, the BHA 110 can include a bit sub, one or more stabilizers, drill collars, jarring devices, crossovers, heavy weight drill collars, or any combination thereof. The BHA 110 can further include one or more measurement-while-drilling (MWD) or logging-while-drilling (LWD) sensors adapted to sense a physical condition of the BHA 110 within the wellbore 104. The length of a conventional BHA 110, including the heavy weight drill collars can be from about 200 feet to about 400 feet.

The drill string 106 generally comprises a series of tubulars connected together, e.g., by threaded engagement. Tubulars are generally constructed in segments ranging between 20 and 40 feet long. As the drill string 106 advances into the subterranean formation 114, an exposed portion of the drill string 106 is reduced, requiring positioning of an additional tubular at the exposed end of the drill string 106. After a new segment of tubular is positioned on the drill string 106, the ROP (or a modified version thereof) is resumed and drilling recommences.

Tubulars used in drill string 106 generally include thin-walled pipe segments, however, additional non-standard segments are often needed on the drill string 106. Subs, as they are sometimes referred to, can include thread cross-overs, collars, and other measuring and sensing assemblies used for measurement or drill string 106 flexure.

As the BHA 110 is lowered deeper into the subterranean formation 114, the drill string 106 can experience one or more forces resulting in drill string compression or deformation. This deformation can become magnified depending on the subterranean formation 114 characteristics (e.g., formation hardness or annulus wall friction—sometimes referred to as stiction). For example, a tubular segment that might be 30 feet when resting on the surface, may have a reduced length when under pressure as part of the drill string 106. Such reduced length, when accounting for the hundreds of tubular segments used to construct the wellbore, can cause small directional course deviations of the BHA 110 over thousands of feet of drilling, putting the BHA 110 off of the intended wellbore target.

Such deviations can make the construction of the wellbore 104 difficult, particularly when operating in extreme environments where drilling must occur in a very specific path. The BHA 110, for example, can begin to drift off course by inches or even several feet as a result of accumulated deformation, compression, or surface friction with the wellbore 104.

In certain instances, the BHA 110 can include a clock (not illustrated) adapted to keep absolute or relative time. In a particular embodiment, the clock can include a clock oscillator or crystal. Such oscillators and crystals can have operational temperature ranges, sensitivities, and accuracies as measured in parts per million (PPM), such as for example +/−20 PPM, or +/−50 PPM, or +/−100 PPM. Clock accuracy can depend on the temperature at or near the BHA 110, or within the wellbore 104, or a combination thereof. Changing wellbore conditions and extreme temperature environments encountered in certain subterranean formations can thus cause the clock to drift, or deviate from absolute. For example, in certain subterranean environments, temperature variations can cause the clock to drift by several seconds per operating hour, amounting to significant deviations in timing over the course of days and weeks of drilling. Systems on the BHA 110 that depend on precise timing can thus also drift as the BHA 110 clock drifts from absolute. For instance, by way of a non-limiting example, a tool (not illustrated) on the BHA 110 can be adapted to change operational protocol every 24 hours. The tool can rely on the time of the clock in the BHA 110 for determining the occurrence of a 24 hour condition. Time shifts associated with drift of the clock can thus alter the effective occurrence of the condition based on the degree of shift exhibited by the clock over the 24 hour span. Further, accumulation of successive 24 hour periods magnify clock drift, further reducing accuracy of the tools operation.

It is an objective of embodiments described herein to mitigate coordinate drift of the BHA 110 (in time and space) and thereby permit optimized construction of the wellbore 104.

In an embodiment, the drill rig 100 can include one or more systems (not illustrated) adapted to monitor at least one drilling criteria of the drilling operation. In an embodiment, the one or more systems can include a clock, such as an atomic clock, a mechanical clock, or another suitable timekeeping device. In a particular embodiment, the one or more systems are disposed at the surface (i.e., not within the wellbore 104). In such a manner, the one or more systems can be isolated from temperature variations encountered within the wellbore 104, thus reducing drift associated with downhole timekeeping. In another embodiment, the one or more systems can include a depth gauge adapted to monitor a depth of the BHA 110. Depth can be measured, for example, by counting a number of tubulars used in the drill string 106 and their lengths. Also, depth can also be measured using a telemetry system, an acoustic system, a wireless or wired protocol, or any combination thereof.

In a particular embodiment, the one or more monitoring systems can be disposed on the drill rig 100. However, such localized placement is not required. In another embodiment, the one or more monitoring systems can be disposed a distance from the drill rig 100 and remotely communicate therewith using a known wired or wireless protocol. The one or more systems can include sensors and detectors, or a time keeping unit such as a clock, or a logic element such as a computer including a microprocessor, or any combination thereof. The one or more systems can monitor the drilling criteria for the occurrence of a condition of the drilling criteria.

The drilling criteria monitored by the drill rig 100 can include, for example, a time (e.g., an absolute time), or an incremental time (e.g., intervals of 60 seconds, or 90 seconds, or 120 seconds, or 240 seconds), or a drilling depth (e.g., an absolute drilling depth), or an incremental drilling depth (e.g., intervals of 1 foot, or 2 feet, or 3 feet), or any combination thereof. In an embodiment, the drilling criteria can relate to a predetermined or preset criteria. By way of a non-limiting example, the monitored drilling criteria can include a preset incremental time. The preset incremental time can be fixed (constant) or variable between successive occurrences. When the preset incremental time is achieved (i.e., the time duration has occurred), the one or more systems can assess the completion of a condition of the drilling criteria (i.e., the completion of the time increment). The drill rig 100 can be adapted to monitor for the occurrence of the condition through either an active or passive monitoring system.

In an embodiment, at least one of the one or more systems adapted to monitor the at least one drilling criteria can include a logic element 120. The logic element 120 can, for example, include an electronic computer including a microprocessor adapted to perform a logical operation. In a particular embodiment, the logic element 120 can use a Boolean-type calculation to determine the occurrence of the condition of the drilling criteria. For example, the logic element 120 can calculate or determine a first state when the condition is not met and calculate or determine a second state when the condition is met. Upon meeting the condition, the logic element 120 can communicate with the communication element 116 the occurrence of the condition. In another embodiment, the logic element 120 and communication element 116 can be part of a same system or discrete unit including a logic component and a communication component. The logic component of the system can detect the occurrence of the condition and the communication component can communicate the occurrence of the condition to the BHA 110.

In a particular instance, the logic element 120 can be coupled with a user interface (not illustrated) adapted to indicate to a drilling operator the occurrence of the condition. The user interface can be disposed, for example, on the drill rig 100, remote from the drill rig 100, or at multiple locations including areas on the drill rig 100 and areas remote from the drill rig 100. In an embodiment, the logic element 120 can be adapted to provide a signal to the drilling operator upon occurrence of the condition. The signal can include, for example, a visual signal, or an auditory signal, or a vibrational signal, or any combination thereof.

After the condition has occurred, the communication element 116 can communicate a marker signal to the BHA 110, relaying the occurrence of the condition of the at least one drilling criteria. This system of monitoring for the condition of the drilling criteria and communicating that condition to the BHA 110 can occur successively, such as at least two consecutive times the condition is met. Thus, for example, the communication element 116 can relay the occurrence of the condition of the drilling criteria (e.g., successive time durations) to the BHA 110 after a first occurrence of the condition and after a second occurrence of the condition. For certain conditions like the passage of an incremental time, the occurrence of the condition may occur at set time intervals. For other conditions, like incremental depth, the occurrence of the condition may occur at variable time intervals. For example, in an embodiment, the one or more monitoring systems can monitor an incremental drilling distance (e.g., 1 foot of penetration into the subterranean formation 114 or 2 feet of penetration into the subterranean formation 114) not tied to a time constraint. Thus, the occurrence of the condition may be variable in time and instead fixed in incremental distance drilled. By way of another example, the one or more monitoring systems can monitor absolute drilling distance (e.g., the drill string is 100 tubular segments long or for 30 foot segments, at a depth of 3000 feet) and the communication element 116 can communicate preset absolute drilling distances to the BHA 110.

In an embodiment, the communication element 116 can include or be in communication with a mud pump adapted to transmit a mud pulse through the wellbore 104. Mud pumps are typically used to circulate drilling fluid, such as mud, through the wellbore to increase ROP. Mud pumps are typically operated at a regulated pressure characteristic sometimes referred to as managed pressure drilling (MPD). Upon occurrence of the condition the mud pump can operate at a momentarily different characteristic, such as sending a mud pulse through the wellbore 104. In an embodiment, the mud pulse can include a positive pressure pulse (i.e., a pulse with a pressure above standard operating pressure at the time of the pulse). In another embodiment, the mud pulse can include a negative pressure pulse (i.e., a pulse with a pressure below standard operating pressure at the time of the pulse).

The mud pulse can be devoid of data or encoded message. The mud pulse indicating occurrence of the condition can, for example, include a discrete pressure spike or pressure drop which can be detected by the BHA 110, as described in greater detail below. In an embodiment, the MPD system can typically operate at a first pressure, $P_1$, different than a pulse pressure, $P_2$, of the pulse. In an embodiment, $P_1/P_2$ can be no greater than 0.99, or no greater than 0.95, or no greater than 0.9, or no greater than 0.75, or no greater than 0.5. In another embodiment $P_1/P_2$ can be at least 1.01, or at least 1.1, or at least 1.25, or at least 1.5. In an embodiment, the mud pulse can have a wavelength duration of less than 5 seconds, or less than 4 seconds, or less than 3 seconds, or less than 2 seconds, or less than 1 second, or less than 0.5 seconds, or less than 0.1 seconds.

In another embodiment, the communication element 116 can include the top drive or kelly (or other driving system) or be in communication therewith. The driving system can thus be adapted to affect a rotational change to the drill string 106. For example, the drive system can typically operate at a first rotational speed, $RPM_1$, different than a rotational speed, $RPM_2$, of the drive system during transmission of the marker signal. In an embodiment, $RPM_1/RPM_2$ can be no greater than 0.99, or no greater than 0.95, or no greater than 0.9, or no greater than 0.75, or no greater than 0.5. In another embodiment, $RPM_1/RPM_2$ can be at least 1.01, or at least 1.1, or at least 1.25, or at least 1.5.

In an embodiment, the changed characteristic (e.g., the change of rotational speed) can be temporary (e.g., less than 5 seconds, or less than 2 seconds, or less than 1 second). For example, the changed rotational speed can comprise a pulse having a period of less than 10 seconds, or less than 5 seconds, or less than 2 seconds, or less than 1 second. In another embodiment, the changed characteristic of rotational speed can be lasting (e.g., greater than 10 seconds, greater than 60 seconds, greater than 600 seconds). For example, the changed rotational speed can remain at the changed speed until a subsequent maker signal is communicated. Communication of the subsequent marker signal can then cause the rotational speed to change again. In an embodiment, the subsequent change can be to the original speed. In another embodiment, the subsequent change can be to a speed different from the original speed and changed speed.

In a further embodiment, the communication element 116 can include a vibrational element adapted to affect a vibrational pulse to the drill string 106. The vibrational element can, for example, communicate a vibrational marker signal to the BHA 110 through vibrationally interfacing with the drill string 106. Upon occurrence of the condition of the drilling criteria, the vibrational element can vibrate the drill string 106.

In other embodiments, the communication element 116 can include a communication protocol selected from an electro-magnetic (EM) system, an acoustic communication system, a wired communication, a wireless protocol, a system adapted to generate pressure changes and gradients in the bore or annular structures of the wellbore 104, a system adapted to adjust a rate of acceleration change in axial movement, a system adapted to change the WOB of the drill string 106, or any combination thereof. In certain embodiments, the communication element 116 can be disposed at or below the surface. In other embodiments, the communication element 116 can be disposed above, or spaced apart from, the surface.

The BHA 110 can include a marker signal receiving device 118 adapted to receive the marker signal. The marker signal receiving device 118 can include, for example, a sensor adapted to detect a mud pulse in the wellbore 104. The marker signal receiving device 118 can also include an accelerometer, or a gyroscope, or a rotational sensor adapted to detect a rotational speed (RPM) of the drill string 106 or BHA 110, or a vibrational sensor adapted to detect a vibrational signal from the communication element 116, or an axial movement accelerometer, or any combination thereof. In an embodiment, the marker signal receiving device 118 can perform a secondary function when not receiving the marker signal from the communication element 116. That is, the marker signal receiving device 118 can have a secondary purpose on the BHA 110. In another embodiment, the marker signal receiving device 118 can be adapted to receive only the marker signal from the communication element 116.

In an embodiment, the communication element 116 can be adapted to communicate the marker signal to the BHA 110 only during a period of time when the drill string 106 is not advancing into the wellbore 104. For example, the communication element 116 can be adapted to communicate the marker signal to the BHA 110 during intervals when the drill string 106 is stopped in the wellbore 104 and an additional segment of tubular is being added to the drill string 116. In another embodiment, the communication element 116 can be adapted to communicate the marker signal to the BHA 110 only during periods of time when the drill string 106 is being actively advanced into the wellbore 104. More specifically, the communication element 116 can be adapted to communicate the marker signal only during active ROP into the subterranean formation 114. In yet a further embodiment, the communication element 116 can be adapted to communicate the marker signal to the BHA 110 at any time—either when the drill string 106 is advancing into the subterranean formation 114 or not advancing in the subterranean formation 114.

In an embodiment, the marker signal comprises a non-digital signal. In a more particular embodiment, the marker signal comprises a physical signal like a mud pulse, an RPM change, or a vibrational interaction induced on the drill pipe 106. In yet a further embodiment, the marker signal is a non-encoded or non-encrypted signal.

In a particular embodiment, the marker signal comprises a one-bit message. As used herein, a "one-bit message" refers to a signal having no personalized or specific content. A one-bit message can transmit only a single binary bit of information. The one-bit message can be devoid of encoded content and convey only the existence of a message. In an embodiment, the one-bit message can be transmitted in a non-digital signal, such as a physical signal (e.g., a mud pulse, or RPM change, or vibrational characteristic, or a combination thereof).

Use of a one-bit message as a marker signal can minimize communication time to the BHA 110 which can reduce drilling cost and increase accuracy. Signals containing data (i.e., non one-bit messages) require a duration of time to completely transmit, during which time the BHA 110 can drift off course. Further, one-bit marker signals reduce the need for extended durations of pressure pulses or other potentially harmful actions within the wellbore 104 which might be dangerous when operating in certain environmental areas or certain subterranean formations 114.

Upon receiving the marker signal, the BHA 110 can determine a coordinate of the BHA 110 in response to the marker signal. As used herein, "determining a coordinate of the BHA" can refer to a coordinate in three dimensional space (e.g., an X-, Y-, Z-field) or a time coordinate. The time coordinate can be an absolute time (e.g., a specific time of day) or a relative time (e.g., the BHA 110 can determine the occurrence of the condition and thus the relative unit of time since the last marker signal was received).

In an embodiment, the systems and methods described herein can include open loop communication protocol whereby the BHA 110 receives the marker signal but does not communicate back with the surface. That is, in accordance with an embodiment, the communication from the communication element 116 to the BHA 110 can be one-directional. In other embodiments, the systems and methods can be closed loop.

Skilled artisans will recognize after reading this entire specification that the repeated communication of a marker signal to the BHA 110 can operate as a beacon to the BHA 110, permitting the BHA 110 to receive and utilize a consistent drilling criteria dependent information for purpose of coordinate determination. In such a manner, the BHA 110 can be prevented form drifting in time or space, thereby saving money and time as well as optimizing wellbore construction.

Embodiment 1

A method of subterranean drilling comprising: monitoring at least one drilling criteria at a surface of a wellbore; communicating a marker signal to a bottom hole assembly of a drill string upon meeting a condition of the at least one drilling criteria; and repeating the marker signal at least two consecutive times the condition is met.

Embodiment 2

The method of embodiment 1, wherein repeating the marker signal is performed every time the condition is met.

Embodiment 3

The method of any one of embodiments 1 and 2, further comprising: receiving the marker signal at the bottom hole assembly; and the bottom hole assembly determining a coordinate of the bottom hole assembly in response to the marker signal.

Embodiment 4

The method of any one of embodiments 1-3, wherein communicating the marker signal to the bottom hole assembly is performed during a period when the drill string is not advancing into the wellbore.

Embodiment 5

A system for subterranean drilling comprising: a drill rig adapted to monitor at least one drilling criteria at a surface of the wellbore; a communication element adapted to communicate a marker signal to a bottom hole assembly of a drill string upon meeting a condition of the at least one drilling criteria, wherein the communication element is adapted to communicate the marker signal to the bottom hole assembly at least two consecutive times the condition is met.

Embodiment 6

The system or method of any one of the preceding embodiments, wherein the marker signal is a non-digital signal.

Embodiment 7

The system or method of any one of the preceding embodiments, wherein the marker signal comprises at least one of a mud pulse, or a rotational change to the drill string, or a vibrational pulse, or any combination thereof.

Embodiment 8

The system or method of any one of the preceding embodiments, wherein the marker signal comprises a one-bit message.

Embodiment 9

The system or method of any one of the preceding embodiments, wherein the drilling criteria comprises an absolute time, a relative time, an absolute drilling depth, an incremental drilling depth, or any combination thereof.

Embodiment 10

The system or method of any one of the preceding embodiments, wherein the condition comprises at least one of a unit time, a unit distance, or a combination thereof.

Embodiment 11

The system or method of any one of the preceding embodiments, wherein the condition comprises an occurrence of a preset time duration.

Embodiment 12

The system or method of embodiment 11, wherein the preset time duration is measured at the surface.

Embodiment 13

The system or method of any one of the preceding embodiments, wherein the condition comprises an advancement of the drill string a preset distance interval into a subterranean feature.

Embodiment 14

The system or method of any one of the preceding embodiments, wherein the bottom hole assembly comprises a marker signal receiving device adapted to receive the marker signal.

Embodiment 15

The system or method of any one of the preceding embodiments, wherein the bottom hole assembly is adapted to determine a coordinate of the bottom hole assembly in response to the marker signal.

Embodiment 16

The system or method of any one of the preceding embodiments, further comprising a logic element.

Embodiment 17

The system or method of embodiment 16, wherein the logic element is in communication with a communication element, and wherein the logic element is adapted to determine the occurrence of the condition.

Embodiment 18

The system or method of any one of embodiments 16 and 17, wherein the logic element is adapted to operate at least partially autonomously or fully autonomously.

Embodiment 19

The system or method of any one of embodiments 16-18, wherein the logic element is disposed at the surface.

Embodiment 20

The system or method of any one of embodiments 16-19, wherein the logic element is coupled with a user interface adapted to indicate to an operator the occurrence of the condition.

Embodiment 21

The system or method of any one of embodiments 16-20, wherein the logic element is adapted to provide a signal to an operator upon occurrence of the condition, and wherein the signal comprises a visual signal, or an auditory signal, or a vibrational signal, or any combination thereof.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

The invention claimed is:

1. A method of subterranean drilling comprising:

monitoring at least one drilling criteria at a surface of a wellbore;

communicating a marker signal to a bottom hole assembly of a drill string upon meeting a condition of the at least one drilling criteria; and repeating the marker signal at least two consecutive times when the condition is met, wherein the marker signal comprises a one-bit message.

2. The method of claim 1, further comprising:

receiving the marker signal at the bottom hole assembly; and the bottom hole assembly determining a coordinate of the bottom hole assembly in response to the marker signal.

3. The method of claim 2, further comprising communicating the marker signal to the bottom hole assembly during a period when the drill string is not advancing into the wellbore.

4. The method of claim 3, wherein the marker signal comprises a non-digital signal.

5. The method of claim 3, wherein the marker signal comprises a mud pulse, or a rotational change to the drill string, or a rate of acceleration change in axial movement, or a vibrational pulse, or any combination thereof.

6. The method of claim 1, wherein the drilling criteria comprises an absolute time, a relative time, an absolute drilling depth, an incremental drilling depth, or any combination thereof.

7. The method of claim 1, wherein the condition comprises a unit time, a unit distance, an occurrence of a preset time duration, an advancement of the drill string a preset distance interval into a subterranean feature, or a combination thereof.

8. The method of claim 1, wherein the bottom hole assembly is adapted to determine a coordinate of the bottom hole assembly in response to the marker signal.

9. The method of claim 1, determining, via a logic element, an occurrence of the condition, with the logic element being adapted to provide a signal to an operator upon occurrence of the condition, wherein the signal comprises a visual signal, or an auditory signal, or a vibrational signal, or any combination thereof.

10. A system for subterranean drilling comprising:

a drill rig adapted to monitor at least one drilling criteria at a surface of a wellbore;

a communication element adapted to communicate a marker signal to a bottom hole assembly of a drill string upon meeting a condition of the at least one drilling criteria, wherein the communication element is adapted to communicate the marker signal to the bottom hole assembly at least two consecutive times when the condition is met, wherein the marker signal comprises a one-bit message.

11. The system of claim 10, wherein the communication element is adapted to communicate the marker signal to the bottom hole assembly, and wherein the bottom hole assembly is adapted to determine a coordinate of the bottom hole assembly in response to the marker signal.

12. The system of claim 11, wherein the communication element is adapted to communicate the marker signal to the bottom hole assembly during a period when the drill string is not advancing into the wellbore.

13. The system of claim 12, wherein the marker signal comprises a non-digital signal.

14. The system of claim 12, wherein the marker signal comprises a mud pulse, or a rotational change to the drill string, or a rate of acceleration change in axial movement, or a vibrational pulse, or any combination thereof.

15. The system of claim 10, wherein the drilling criteria comprises an absolute time, a relative time, an absolute drilling depth, an incremental drilling depth, or any combination thereof.

16. The system of claim 10, wherein the condition comprises a unit time, a unit distance, an occurrence of a preset time duration, an advancement of the drill string a preset distance interval into a subterranean feature, or any combination thereof.

17. The system of claim 10, wherein the bottom hole assembly is adapted to determine a coordinate of the bottom hole assembly in response to the marker signal.

18. The system of claim 10, further comprising a logic element communicatively coupled to the communication element, the logic element adapted to detect an occurrence of the condition and to provide a signal to an operator upon an occurrence of the condition, wherein the signal comprises a visual signal, or an auditory signal, or a vibrational signal, or any combination thereof.

* * * * *